US010801092B2

(12) United States Patent
Koh et al.

(10) Patent No.: US 10,801,092 B2
(45) Date of Patent: Oct. 13, 2020

(54) THICK STEEL PLATE HAVING EXCELLENT LOW-TEMPERATURE TOUGHNESS AND HYDROGEN-INDUCED CRACKING RESISTANCE, AND METHOD FOR MANUFACTURING SAME

(71) Applicant: POSCO, Pohang-si, Gyeongsangbuk-do (KR)

(72) Inventors: Seong-Ung Koh, Pohang-si (KR); Jae-Hyun Park, Pohang-si (KR); Yoen-Jung Park, Pohang-si (KR); Moo-Jong Bae, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 256 days.

(21) Appl. No.: 16/060,755

(22) PCT Filed: Dec. 16, 2016

(86) PCT No.: PCT/KR2016/014813
§ 371 (c)(1),
(2) Date: Jun. 8, 2018

(87) PCT Pub. No.: WO2017/111398
PCT Pub. Date: Jun. 29, 2017

(65) Prior Publication Data

US 2018/0355461 A1 Dec. 13, 2018

(30) Foreign Application Priority Data

Dec. 21, 2015 (KR) ..... 10-2015-0183268

(51) Int. Cl.
*C22C 38/58* (2006.01)
*C22C 38/42* (2006.01)
(Continued)

(52) U.S. Cl.
CPC ..... *C22C 38/58* (2013.01); *B21B 3/00* (2013.01); *C21D 6/00* (2013.01); *C21D 6/004* (2013.01);
(Continued)

(58) Field of Classification Search
CPC ..... C22C 38/58; C22C 38/00; C22C 38/001; C22C 38/002; C22C 38/02; C22C 38/06;
(Continued)

(56) References Cited

U.S. PATENT DOCUMENTS

2012/0009434 A1 1/2012 Hata et al.
2015/0090370 A1* 4/2015 Shimamura ..... C22C 38/50 148/521
(Continued)

FOREIGN PATENT DOCUMENTS

CN 103014553 A 4/2013
EP 2894235 A1 7/2015
(Continued)

OTHER PUBLICATIONS

Japanese Office Action dated Jul. 2, 2019 issued in Japanese Patent Application No. 2018-530014.
(Continued)

*Primary Examiner* — Anthony J Zimmer
*Assistant Examiner* — Ricardo D Morales
(74) *Attorney, Agent, or Firm* — Morgan, Lewis & Bockius LLP

(57) ABSTRACT

The present invention relates to a thick steel plate having excellent low-temperature toughness and hydrogen-induced cracking resistance, and a method for manufacturing the same.

10 Claims, 1 Drawing Sheet

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 8/02*** | (2006.01) |
| ***B21B 3/00*** | (2006.01) |
| ***C21D 6/00*** | (2006.01) |
| ***C22C 38/00*** | (2006.01) |
| ***C22C 38/14*** | (2006.01) |
| ***C22C 38/12*** | (2006.01) |
| ***C22C 38/02*** | (2006.01) |
| ***C22C 38/06*** | (2006.01) |

(52) U.S. Cl.
CPC ..... *C21D 6/005* (2013.01); *C21D 6/008* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/02* (2013.01); *C22C 38/06* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/004* (2013.01); *C21D 2211/005* (2013.01); *C21D 2211/008* (2013.01)

(58) Field of Classification Search
CPC ..... C22C 38/12; C22C 38/14; C22C 38/42; C22C 38/44; C22C 38/46; C22C 38/48; C22C 38/50; C21D 6/00; C21D 6/004; C21D 6/005; C21D 6/008; C21D 8/0205; C21D 8/0226; C21D 8/0263; B21B 3/00
See application file for complete search history.

(56) References Cited

U.S. PATENT DOCUMENTS

| | | | |
|---|---|---|---|
| 2016/0017466 | A1 | 1/2016 | Shibata et al. |
| 2016/0312327 | A1 | 10/2016 | Ichimiya et al. |

FOREIGN PATENT DOCUMENTS

| | | | | |
|---|---|---|---|---|
| EP | 2949772 | A1 | 12/2015 | |
| EP | 3026140 | A1 | 6/2016 | |
| EP | 3026140 | B1 * | 9/2018 | ..... C12D 8/0263 |
| JP | H10-096022 | A | 4/1998 | |
| JP | 3474661 | B2 | 12/2003 | |
| JP | 2006-265577 | A | 10/2006 | |
| JP | 2008-101242 | A | 5/2008 | |
| JP | 2010-037652 | A | 2/2010 | |
| JP | 2010-229442 | A | 10/2010 | |
| JP | 2013-139630 | A | 7/2013 | |
| JP | 2013-227671 | A | 11/2013 | |
| KR | 10-2004-0021117 | A | 3/2004 | |
| KR | 10-0833070 | B1 | 5/2008 | |
| KR | 10-2009-0053558 | A | 5/2009 | |
| KR | 10-2010-0032490 | A | 3/2010 | |
| KR | 10-2011-0097519 | A | 8/2011 | |
| KR | 10-2015-0122779 | A | 11/2015 | |
| WO | 99/05334 | A1 | 2/1999 | |
| WO | 2015/012317 | A1 | 1/2015 | |
| WO | 2015/088040 | A1 | 6/2015 | |

OTHER PUBLICATIONS

Extended European Search Report dated Sep. 12, 2018 issued in European Patent Application No. 16879265.3.
International Search Report dated Mar. 6, 2017 issued in International Patent Application No. PCT/KR2016/014813 (with English translation).

* cited by examiner

[FIG. 1]
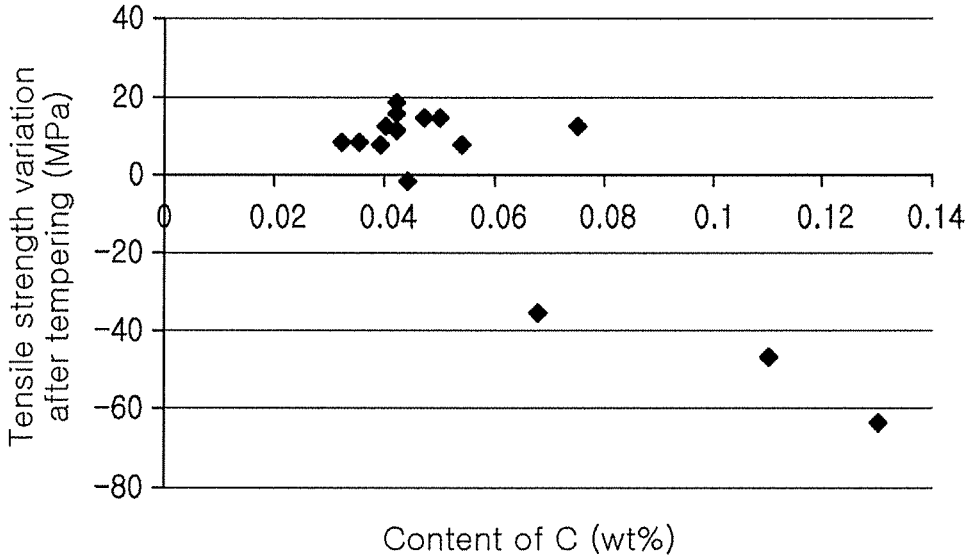
[FIG. 2]
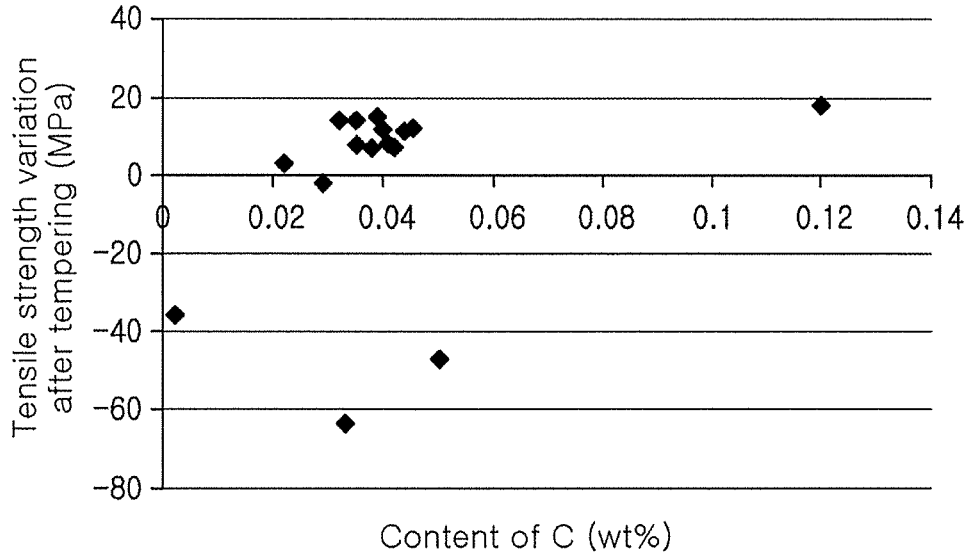

THICK STEEL PLATE HAVING EXCELLENT LOW-TEMPERATURE TOUGHNESS AND HYDROGEN-INDUCED CRACKING RESISTANCE, AND METHOD FOR MANUFACTURING SAME

CROSS REFERENCE

This patent application is the U.S. National Phase under 35 U.S.C. § 371 of International Application No. PCT/KR2016/014813, filed on Dec. 16, 2016, which claims the benefit of Korean Patent Application No. 10-2015-0183268, filed on Dec. 21, 2015, the entire contents of each are hereby incorporated by reference.

TECHNICAL FIELD

The present disclosure relates to a thick steel plate used for a line pipe, a process pipe or the like, and a method for manufacturing the same, and more particularly, to a thick steel plate having excellent low-temperature toughness and hydrogen-induced cracking resistance, and a method for manufacturing the same.

BACKGROUND ART

A thick steel plate for guaranteeing hydrogen-induced cracking (HIC) of API standards is used for a line pipe, a process pipe and the like, and the required physical properties of a steel material are determined according to the material to be stored in a container and the use environment. In addition, when it is applied to a process pipe of oil refinery equipment, it is mostly used at high temperature, and thus, a heat treatment type pipe of which physical properties are less changed at high temperature is applied.

Therefore, in the case that the materials treated by a steel material are at low temperature, or used in a cold area, low-temperature toughness is often required. Recently, as the energy industry has further developed, steel materials necessary for oil refinery equipment are more necessary, and considering the environment in which each type of equipment is used, demand for steel materials having excellent hydrogen-induced cracking resistance, and also excellent toughness, even at low temperature, is increasing.

In general, as the use temperature is lowered, a steel material has decreased toughness, and easily produces and propagates cracks, even with weak impacts, thereby having a great influence on the stability of materials.

Therefore, the steel material having a low use temperature has a controlled component or microstructure. As a general method for increasing low-temperature toughness, a method of significantly reducing the addition of impurities such as sulfur or phosphorus, and properly adding an amount of alloying elements which help to improve low-temperature toughness, like Ni, is used.

Unlike a TMCP material, a heat treatment type pipe steel material needs a carbon equivalent, higher than that of the TMCP material for securing the same degree of strength, due to the nature of a heat treated material. However, since the steel materials used for a line pipe and a process pipe involves a welding process in the manufacturing process thereof, they represent better weldability when having a lower carbon equivalent.

In addition, since center segregation causing HIC and low-temperature DWTT properties relative to the TMCP material is deteriorated with a high carbon equivalent of the heat treatment material, it is necessary to devise a method of lowering the carbon equivalent, simultaneously with securing high strength.

A common quenching+ tempering heat treatment material is subjected to a quenching heat treatment at a temperature equivalent to or higher than the use temperature, for significantly decreasing strength loss at the use temperature of the steel. The guaranteed temperature of common quenching+ tempering heat treatment material is about 620° C., and at a carbon equivalent of 0.45 or less, a material of a tensile strength grade of 500 MPa may be secured up to a thickness of 80 mm.

For hydrogen-induced cracking resistance and low-temperature toughness improvement, the following techniques have been suggested so far.

Korean Patent Laid-Open Publication No. 2004-0021117 suggests a steel material of a tensile strength grade of 600 MPa for pressure vessels, having excellent toughness, used in the material for a boiler in a power plant, pressure vessels and the like, and Korean Patent Registration No. 0833070 suggests a thick steel plate for pressure vessels satisfying a tensile strength grade of 500 MPa, while having excellent hydrogen-induced cracking resistance.

However, these steel materials have a high content of carbon, so that it is still difficult to secure excellent weldability and hydrogen-induced cracking resistance, and have larger decrease in strength after tempering.

DISCLOSURE

Technical Problem

An aspect of the present disclosure is to provide a thick steel plate having excellent low-temperature toughness and hydrogen-induced cracking resistance by optimizing the steel components and microstructure.

Another aspect of the present disclosure is to provide a method for manufacturing a thick steel plate having excellent low-temperature toughness and hydrogen-induced cracking resistance by properly controlling steel components and manufacturing conditions to optimize a microstructure.

Technical Solution

According to an aspect of the present disclosure, a thick steel plate having excellent low-temperature toughness and hydrogen-induced cracking resistance includes: 0.02-0.08 wt % of C, 0.1-0.5 wt % of Si, 0.8-2.0 wt % of Mn, 0.03 wt % or less of P, 0.003 wt % or less of S, 0.06 wt % or less of Al, 0.01 wt % or less of N, 0.005-0.1 wt % of Nb, 0.005-0.05 wt % of Ti and 0.0005-0.005 wt % of Ca, one or two of 0.005-0.3% of Cu and 0.005-0.5% of Ni, and one or more of 0.05-0.5 wt % of Cr, 0.02-0.4 wt % of Mo and 0.005-0.1 wt % of V, with a balance of Fe and other unavoidable impurities, the thick steel plate having a carbon equivalent (Ceq) as defined by the following Equation 1 satisfying 0.45 or less:

$$\text{Carbon equivalent (Ceq)} = C + Mn/6 + (Cr+Mo+V)/5 + (Cu+Ni)/15 \quad \text{[Equation 1]}$$

wherein C, Mn, Cr, Mo, V, Cu, and Ni represent the content of each element by wt %, and a weight ratio of Ca/S satisfying a range between 0.5 and 5.0, and including tempered bainite (including tempered acicular ferrite) or tempered martensite as a matrix structure, wherein the length of the longest side of a Ti-based, Nb-based, or Ti—Nb composite carbonitride within 5 mm upwards and downwards with respect to a thickness center is 10 μm or less.

According to another aspect of the present disclosure, a method for manufacturing a thick steel plate having excellent low-temperature toughness and hydrogen-induced cracking resistance includes: reheating a steel slab at 1,100-1,300° C., the steel slab including 0.02-0.08 wt % of C, 0.1-0.5 wt % of Si, 0.8-2.0 wt % of Mn, 0.03 wt % or less of P, 0.003 wt % or less of S, 0.06 wt % or less of Al, 0.01 wt % or less of N, 0.005-0.1 wt % of Nb, 0.005-0.05 wt % of Ti and 0.0005-0.005 wt % of Ca, one or two of 0.005-0.3% of Cu and 0.005-0.5% of Ni, and one or more of 0.05-0.5 wt % of Cr, 0.02-0.4 wt % of Mo and 0.005-0.1 wt % of V, with a balance of Fe and other unavoidable impurities, having a carbon equivalent (Ceq) as defined by the following Equation 1 satisfying 0.45 or less:

$$\text{Carbon equivalent (Ceq)}=C+Mn/6+(Cr+Mo+V)/5+(Cu+Ni)/15 \quad \text{[Equation 1]}$$

wherein C, Mn, Cr, Mo, V, Cu, and Ni represent the content of each element by wt %, and a Ca/S weight ratio satisfying a range of 0.5-5.0, then finish rolling the steel slab with a cumulative rolling reduction ratio of 40% or more at a temperature of Ar3+100° C.-Ar3+30° C., starting direct quenching with a cooling rate as defined by the following Equation 2 at a temperature of Ar3+80° C.-Ar3 and finishing cooling at 500° C. or less:

$$20{,}000/\text{Thickness}^2(\text{mm}^2)\leq\text{cooling rate}(^\circ\text{ C./sec})\leq 60{,}000/\text{thickness}^2\ (\text{mm}^2), \quad \text{[Equation 2]}$$

and performing reheating at a temperature of 580-700° C. and air cooling.

Advantageous Effects

As set forth above, according to an exemplary embodiment in the present disclosure, not only a thick steel plate having excellent low-temperature DWTT properties and hydrogen-induced cracking resistance may be provided, but also a thick, high-strength steel plate of a tensile strength grade of 500 MPa or higher up to a thickness of 80 mm, having excellent weldability with a low carbon equivalent may be provided.

DESCRIPTION OF DRAWINGS

FIG. 1 is a graph representing a tensile strength variation before and after tempering heat treatment depending on the content of C.

FIG. 2 is a graph representing a tensile strength variation before and after tempering heat treatment depending on the content of Nb.

BEST MODE FOR INVENTION

Hereinafter, the present disclosure will be described in detail.

The present disclosure provides thick and thick plate steel materials of a tensile strength grade of 500 MPa or higher, having excellent low-temperature DWTT properties and hydrogen-induced cracking resistance, by optimizing the steel components and microstructure.

Though present disclosure has a low carbon equivalent unlike the prior art, it provides thick plate direct quenching-tempering heat treatment steel materials of 500 MPa grade. For this, the content of carbon is lowered and Nb is utilized, thereby providing a steel plate of a tensile strength grade of 500 MPa or higher, having excellent low-temperature DWTT properties and excellent hydrogen-induced cracking resistance.

Unlike a TMCP material, a heat treatment type pipe steel material needs a carbon equivalent, higher than that of the TMCP material for securing the same strength, due to the nature of a heat treatment material. However, since the steel materials used for a line pipe and a process pipe involves a welding process in the manufacturing process thereof, they represent better weldability when having a lower carbon equivalent.

In addition, since center segregation causing HIC and low-temperature DWTT properties relative to the TMCP material is deteriorated with a high carbon equivalent of the heat treatment material, it is necessary to devise a method of lowering the carbon equivalent, simultaneously with securing of high strength.

A common quenching+ tempering heat treatment material is subjected to quenching heat treatment at a temperature equivalent to or higher than the use temperature, for significantly decreasing strength loss at the use temperature of the steel.

The guaranteed temperature of common quenching + tempering heat treatment material is about 620° C., and at a carbon equivalent of 0.45 or less, a material of a tensile strength grade of 500 MPa may be secured up to a thickness of 80 mm.

The present inventors repeated studies and experiments for providing a more appropriate steel material for various customer use environments such as a high temperature environment, and as a result, confirmed that with a component system having a high carbon equivalent, it is difficult to secure excellent weldability, and also low-temperature DWTT properties and HIC resistance may not be dramatically improved, and completed the present disclosure through further study and experiments to solve this.

The present disclosure is to decrease the content of carbon, an element having a greatest influence on a carbon equivalent increase, and to induce formation of a precipitate upon tempering, based on the idea to use precipitation in a tempering temperature range to compensate for strength reduction by tempering.

That is, it was found that in the case that the content of carbon is high, Nb is all precipitated during a rolling process so that a precipitated amount upon tempering is decreased, and thus, the strength reduction by tempering may not be compensated, however, in the case that the content of carbon is low, Nb is not precipitated during a rolling process, and remaining, solid-solubilized Nb is precipitated upon tempering, thereby compensating the strength reduction by tempering, deemed to be a synergistic effect by use of a low carbon component system.

Moreover, the present disclosure applies low-temperature finish rolling immediately above Ar3 simultaneously with control of steel components, to finely control the size of Ti-based, Nb-based, or Ti—Nb composite-based carbonitrides precipitated during rolling, thereby further improving center DWTT properties and HIC resistance.

Hereinafter, the thick steel plate having excellent low-temperature toughness and hydrogen-induced cracking resistance according to an aspect of the present disclosure will be described.

C: 0.02-0.08 wt %

C is closely related to the manufacturing method together with other components. Among the steel components, C has a greatest influence on the characteristics of the steel material. When the content of C is less than 0.02 wt %, component control costs during a steel manufacturing process are excessively incurred, and a welding heat-affected zone is softened more than necessary. Meanwhile, when the content of C is more than 0.08 wt %, the low-temperature DWTT properties and hydrogen-induced resistance of the steel plate are decreased, weldability is deteriorated, and most added Nb is precipitated during a rolling process, thereby decreasing a precipitated amount upon tempering.

Therefore, it is preferable to limit the content of C to 0.02-0.08 wt %.

Si: 0.1-0.5 wt %

Si not only acts as a deoxidizer in a steel manufacturing process, but also serves to raise the strength of the steel material. When the content of Si is more than 0.5 wt %, the low-temperature DWTT properties of the material is deteriorated, weldability is lowered, and scale peelability is caused upon rolling, however, when the content is decreased to 0.1 wt % or less, manufacturing costs rise, and thus, it is preferable to limit the content to 0.1-0.5 wt %.

Mn: 0.8-2.0 wt %

Mn is an element which does not inhibit low-temperature toughness while improving quenching properties, and it is preferable to add 0.8 wt % or more of Mn. However, when added in an amount more than 2.0 wt %, center segregation occurs to not only decrease low-temperature toughness, but also to raise the hardenability of a steel and decrease weldability. In addition, since Mn center segregation is a factor to cause hydrogen-induced cracking, it is preferable to limit the content to 0.8-2.0 wt %. In particular, 0.8-1.6 wt % is more preferable in terms of center segregation.

P: 0.03 wt % or less

P is an impurity element, and when the content is more than 0.03 wt %, weldability is significantly decreased, and also low-temperature toughness is decreased, and thus, it is preferable to limit the content to 0.03 wt % or less. In particular, 0.01 wt % or less is more preferable in terms of low-temperature toughness.

S: 0.003 wt % or less

S is also an impurity element, and when the content is more than 0.003 wt %, the ductility, low-temperature toughness and weldability of steel are decreased. Therefore, it is preferable to limit the content to 0.003 wt % or less. In particular, since S is bonded to Mn to form a MnS inclusion and decrease the hydrogen-induced cracking resistance of steel, 0.002 wt % or less is more preferable.

Al: 0.06 wt % or less

Usually, Al serves as a deoxidizer which reacts with oxygen present in molten steel to remove oxygen. Therefore, it is general to add Al in an amount to provide a steel material with sufficient deoxidation ability. However, when added more than 0.06 wt %, a large amount of an oxide-based inclusion is formed to inhibit the low-temperature toughness and hydrogen-induced cracking resistance of a material, and thus, the content is limited to 0.06 wt % or less.

N: 0.01 wt % or less

Since it is difficult to industrially completely remove N from steel, the upper limit thereof is 0.01 wt % which may be allowed in a manufacturing process. N forms nitrides with Al, Ti, Nb, V, etc., to inhibit austenite crystal grin growth, and to help toughness and strength improvement, however, when the content is excessive and more than 0.01 wt %, N is present in a solid-solubilized state, and N in the solid-solubilized state has an adverse influence on low-temperature toughness. Thus, it is preferable to limit the content to 0.01 wt % or less.

Nb: 0.005-0.1 wt %

Nb is solid-solubilized when reheating a slab, and inhibits austenite crystal grain growth during hot rolling, and then is precipitated to improve the strength of steel. In addition, Nb is bonded to carbon when tempering heat treatment to form a low-temperature precipitate phase, and serves to compensate for the strength reduction upon tempering.

However, when Nb is added in an amount less than 0.005 wt %, it is difficult to secure the precipitated amount of the Nb-based precipitate upon tempering, sufficient to compensate for the strength decrease upon tempering, and growth of austenite crystal grains occurs during a rolling process to decrease low-temperature toughness.

However, when Nb is excessively added in an amount more than 0.1 wt %, austenite crystal grains are refined more than necessary to serve to lower the quenching property of steel, and a coarse Nb-based inclusion is formed to decrease low-temperature toughness, and thus, the content of Nb is limited to 0.1 wt % or less, in the present disclosure. In terms of low-temperature toughness, it is more preferable to add 0.05 wt % or less of Nb.

Ti: 0.005-0.05 wt %

Ti is an element effective in inhibiting the growth of austenite crystal grains by being bonded to N when reheating the slab to form TiN. However, when Ti is added in an amount less than 0.005 wt %, the austenite crystal grains become coarse to decrease low-temperature toughness, and when added in an amount more than 0.05 wt %, a coarse Ti-based precipitate is formed to decrease low-temperature toughness and hydrogen-induced cracking resistance, and thus, it is preferable to limit the content of Ti to 0.005-0.05 wt %. In terms of low-temperature toughness, it is more preferable to add 0.03 wt % or less of Ti.

Ca: 0.0005-0.005 wt %

Ca serves to spheroidize MnS inclusions. MnS, an inclusion having a low melting point, produced in the center, is stretched upon rolling to be present as a stretched inclusion in the center of steel, and present in a large amount, and thus, when MnS is partially dense, it serves to decrease elongation when stretched in a thickness direction. The added Ca reacts with MnS to surround MnS, thereby interfering with the stretching of MnS. In order to represent this MnS spheroidizing effect, Ca should be added in an amount 0.0005 wt % or more. Since Ca has high volatility and thus, has a low yield, considering the load produced in the steel manufacturing process, it is preferable that the upper limit of Ca is 0.005 wt %.

In the present disclosure, other than the above components, one or two of 0.005-0.3 wt % of Cu and 0.005-0.5 wt % of Ni; and one or more of 0.05-0.5 wt % of Cr, 0.02-0.4 wt % of Mo, and 0.005-0.1 wt % of V are added.

Cu: 0.005-0.3 wt %

Cu is a component which serves to improve strength, and when the content is less than 0.005 wt %, this effect may not be sufficiently achieved. Therefore, it is preferable that the lower limit of the content of Cu is 0.005%. Meanwhile, when Cu is excessively added, surface quality is deteriorated, and thus, it is preferable that the upper limit of the content of Cu is 0.3%.

Ni: 0.005-0.5 wt %

Ni is a component which improves strength, but does not decrease toughness.

Ni is added for surface characteristics when Cu is added.

When the content is less than 0.005 wt %, this effect may not be sufficiently achieved.

Therefore, it is preferable that the lower limit of the content of Ni is 0.005%. Meanwhile, when Ni is excessively added, a cost increase is incurred due to its high price, and thus, it is preferable that the upper limit of the content of Ni is 0.5%.

Cr: 0.05-0.5 wt %

Cr is solid-solubilized in austenite, when reheating a slab, thereby serving to increase a quenching property of a steel material. However, when Cr is added in an amount more than 0.5 wt %, weldability is decreased, and thus, it is preferable to limit the content to 0.05-0.5 wt %.

Mo: 0.02-0.4 wt %

Mo is an element similar to or has more aggressive effects than Cr, and serves to increase the quenching property of a steel material and prevent a strength decrease of a heat treatment material. However, when Mo is added in an amount less than 0.02 wt %, it is difficult to secure the quenching property of steel, and also a strength decrease after heat treatment is excessive, whereas when added in an amount more than 0.4 wt %, a structure having vulnerable low-temperature toughness is formed, weldability is decreased, and temper embrittlement is caused, and thus, it is preferable to limit the content of Mo to 0.02-0.4 wt %.

V: 0.005-0.1 wt %

V increases the quenching property of steel, but also is a main element to prevent strength decrease by being precipitated when reheating a heat treatment material. However, when V is added in an amount less than 0.005 wt %, it has no effect to prevent strength decrease of a heat treatment material, and when added in an amount more than 0.1 wt %, low-temperature phases are formed due to the quenching property increase of steel to decrease low-temperature toughness and hydrogen-induced cracking resistance, and thus, it is preferable to limit the content of V to 0.005-0.1 wt %. In terms of low-temperature toughness, 0.05 wt % or less is more preferable.

Carbon equivalent (Ceq): 0.45 or less

It is preferable that the carbon equivalent (Ceq) as defined by the following Equation 1 is limited to 0.45 or less:

$$\text{Carbon equivalent (Ceq)}=C+Mn/6+(Cr+Mo+V)/5+(Cu+Ni)/15 \quad \text{[Equation 1]}$$

wherein C, Mn, Cr, Mo, V, Cu, and Ni represent the content of each element by wt %, When the carbon equivalent (Ceq) is more than 0.45, weldability is decreased and alloy costs are increased, and when the carbon equivalent is more than 0.45 without an increase of alloy costs, the content of carbon is increased, thereby not only decreasing the low-temperature DWTT properties and hydrogen-induced cracking resistance of steel, but also increasing strength reduction after tempering heat treatment, and thus, it is preferable that the upper limit of the carbon equivalent is 0.45. More preferable carbon equivalent (Ceq) is 0.37-0.45, and in this case, it is easy to secure strength of a 500 MPa grade.

Weight ratio of Ca/S:0.5-5.0

The weight ratio of Ca/S is an index representing MnS center segregation and coarse inclusion formation, and when the weight ratio is less than 0.5, MnS is formed in the center of a steel plate thickness to decrease hydrogen-induced cracking resistance, whereas when the weight ratio is more than 5.0, a Ca-based coarse inclusion is formed to decrease hydrogen-induced cracking resistance, and thus, it is preferable to limit the weight ratio of Ca/S to 0.5-5.0.

Matrix structure: Tempered bainite [including tempered acicular ferrite] or tempered martensite Low carbon bainite is represented by acicular ferrite, or sometimes bainite and acicular ferrite are used together, and in the present disclosure, this acicular ferrite is also included.

Though the thick steel plate having excellent low-temperature DWTT properties and hydrogen-induced cracking resistance of the present disclosure is thick, having a thickness of 80 mm or less, it is the steel which maintains high strength of a tensile strength grade of 500 MPa or higher, and at the same time, has excellent low-temperature DWTT properties and hydrogen-induced cracking resistance, and includes a tempered bainite (including acicular ferrite) or tempered martensite phase as a matrix structure.

When the matrix structure is formed of ferrite and pearlite, the strength is low, and hydrogen-induced cracking resistance and low-temperature toughness is deteriorated, and thus, it is preferable in the present disclosure that the matrix structure is limited to tempered bainite (including acicular ferrite) or tempered martensite.

Length of the longest side of Ti-based, Nb-based or Ti—Nb composite-based carbonitride within 5 mm upwards and downwards with respect to a thickness center: 10 μm or less A Ti-based, Nb-based or Ti—Nb composite-based carbonitride brings crystal grain refining and weldability improvement, and a TiN precipitate inhibits austenite crystal grain growth during a reheating process of steel, and a Nb precipitate is solid-solubilized again during a reheating process to inhibit austenite crystal grain growth during a rolling process. However, when the Ti-based, Nb-based or Ti—Nb composite-based carbonitride and the like are coarsely precipitated in the center during a rolling process or a heat treatment process, low-temperature DWTT properties and hydrogen-induced cracking resistance are decreased, and thus, in the present disclosure, the length of the longest side of the precipitate within 5 mm upwards and downwards with respect to a thickness center is limited to 10 μm or less.

The thick steel plate of the present disclosure has a tensile strength decrease after tempering relative to the tensile strength before tempering is 30 MPa or less, and even after tempering treatment, has the tensile strength of a 500 MPa grade or higher, and may have excellent low-temperature DWTT properties and excellent hydrogen-induced cracking resistance.

The thick steel plate of the present disclosure may have a thickness of preferably 80 mm or less, more preferably 40-80 mm.

Hereinafter, the method for manufacturing a thick steel plate having excellent low-temperature toughness and hydrogen-induced cracking resistance according to another aspect of the present disclosure will be described.

The method for manufacturing a thick steel plate having excellent low-temperature toughness and hydrogen-induced cracking resistance according to another aspect of the present disclosure includes reheating a steel slab having the above-described steel composition at 1100-1300° C., finish rolling the steel slab with a cumulative rolling reduction ratio of 40% or more at a temperature of Ar3+100° C.-Ar3+30° C., starting direct quenching with a cooling rate as defined by the following Equation 2 at a temperature of Ar3+80° C.-Ar3 and finishing cooling at 500° C. or less, and performing reheating at a temperature of 580-700° C. and air cooling:

$$20{,}000/\text{Thickness}^2(\text{mm}^2) \leq \text{cooling rate}(^\circ\text{C./sec}) \leq 60{,}000/\text{thickness}^2\ (\text{mm}^2) \quad \text{[Equation 2]}$$

Ar3 may be calculated by the following Equation 3:

$$Ar3=910-310*C-80*Mn-20*Cu-15*Cr-55*Ni-80*Mo+0.35*[\text{thickness (mm)}-8] \quad \text{[Equation 3]}$$

Heating temperature: 1100-1300° C.

In a process of heating the steel slab at a high temperature for hot rolling, when the heating temperature is more than 1300° C., austenite crystal grains become coarse to decrease the low-temperature DWTT properties of steel, and when the heating temperature is less than 1100° C., an alloy element re-solid solubilization rate is decreased, and thus, it is preferable to limit the reheating temperature to 1100-1300° C., and in terms of low-temperature toughness, it is more preferable to limit the reheating temperature to 1100-1200° C.

Finish rolling temperature: Ar3+100° C.-Ar3+30° C.

When the finish rolling temperature is more than Ar3+100° C., crystal grains and Nb precipitates grow to decrease low-temperature DWTT properties, and when the finish rolling temperature is less than Ar3+30° C., cooling initiation temperature upon direct quenching is lowered to Ar3 or less, thereby starting cooling in an abnormal region, which causes superfine ferrite to be formed before starting cooling to decrease the strength of steel, and thus, it is preferable to limit the finish rolling temperature to Ar3+100° C.-Ar3+30° C.

Cumulative rolling reduction ratio upon finish rolling: 40% or more

When the cumulative rolling reduction ratio upon finish rolling is less than 40%, recrystallization by rolling does not occur to the center, thereby causing center crystal grain to be coarse and deteriorating low-temperature DWTT properties, and thus, it is preferable to limit the cumulative rolling reduction ratio upon finish rolling to 40% or more.

Cooling method: After initiating direct quenching at Ar3+80° C.-Ar3, ending at 500° C. or less The cooling method of the present disclosure is to initiate cooling in an austenite single phase region after ending finish rolling to perform direct quenching, and the method performs cooling immediately after ending rolling without reheating, unlike common quenching heat treatment.

In the common quenching heat treatment, a material air-cooled after rolling is reheated and quenched, however, when common quenching heat treatment is applied to the component-based steel suggested by the present disclosure, a rolling structure disappears, so that tensile strength of a 500 MPa grade may not be secured.

In the present disclosure, when direct quenching initiation temperature is more than Ar3+80° C., finish rolling temperature is more than Ar3+100° C., and when direct quenching initiation temperature is less than Ar3, superfine ferrite is formed before direct quenching, so that the strength of steel may not be secured, and thus, it is preferable to limit the direct quenching initiation temperature to Ar3+80° C.-Ar3.

In the present disclosure, it is preferable to limit the cooling end temperature to 500° C. or less, and when the cooling end temperature is more than 500° C., cooling is insufficient, so that the microstructure to be obtained in the present disclosure may not be implemented, and also the tensile strength of the steel plate may not be secured.

Direct quenching cooling rate: satisfying the following Equation 2

It is preferable that the direct quenching cooling rate after rolling is limited to the range satisfying the following Equation 2:

$$20{,}000/\text{thickness}^2(\text{mm}^2) \leq \text{cooling rate}(^\circ\text{ C./sec}) \leq 60{,}000/\text{thickness}^2\ (\text{mm}^2) \quad \text{[Equation 2]}$$

When the quenching cooling rate is less than 20,000/thickness$^2$ (mm$^2$), it is impossible to secure strength, and when the quenching cooling rate is more than 60,000/thickness$^2$ (mm$^2$), shape deformation and productivity resistance of the steel plate are caused, and thus, it is preferable to limit the range of the cooling rate for direct quenching so as to satisfy the above Equation 2.

Tempering temperature: 580-700° C.

Tempering is performed for preventing additional strength decrease in the use temperature of the steel plate, by reheating a steel plate hardened by direct quenching treatment in a constant temperature range and cooling it by air.

In the component system of the present disclosure, Nb, Cr, Mo and V-based precipitates are precipitated upon tempering, and even after tempering, a decrease in tensile strength is 30 MPa or less, and thus, strength decrease by tempering is not large.

However, when the tempering temperature is more than 700° C., precipitates become coarse and cause a strength decrease, and meanwhile, when the tempering temperature is less than 580° C., strength is increased, but a strength decrease occurs at a common use temperature of the steel material, which is not preferable, and thus, it is preferable to limit the tempering temperature to 580-700° C.

In order to secure an optimal combination of low-temperature toughness and strength, it is more preferable to limit the tempering temperature to 600-680° C.

According to the present disclosure, a decrease in tensile strength after tempering to the tensile strength before tempering is 30 MPa or less, and even after tempering treatment, a steel plate having excellent low-temperature DWTT properties of a tensile strength grade of 500 MPa or higher and excellent hydrogen-induced cracking resistance may be provided.

[Mode for Invention]

Hereinafter, the present disclosure will be described in detail through the Examples. However, it should be noted that the following Examples are only for embodying the present disclosure by illustration, and not intended to limit the right scope of the present disclosure. The reason is that the right scope of the present disclosure is determined by the matters described in the claims and reasonably inferred therefrom.

EXAMPLES

Molten steel having the composition as shown in the following Table 1 was prepared, and then a steel slab was manufactured by using continuous casting. The following steel slab was subjected to hot rolling, direct quenching and tempering heat treatment under the conditions as shown in the following Table 2, thereby manufacturing a steel plate.

The values of the components described in the following Table 1 refer to those by wt %.

Comparative steels 1 to 13 were out of the ranges of components, a carbon equivalent and a Ca/S ratio which are limited in the present disclosure, and Comparative steels 14 to 22 were out of the ranges of the manufacturing conditions which are limited in the present disclosure, as shown in the following Table 2.

For the steel plates as manufactured above, a microstructure, a length (micron) of the longest side of Ti- and Nb-based carbonitride in the thickness center, tensile strength before tempering (MPa), tensile strength after tempering (MPa), tensile strength variation before and after tempering treatment (MPa), a DWTT shear fracture percentage (−20° C.) and hydrogen-induced cracking resistance were examined, and the results are shown in the following Table 3.

TABLE 1

| Steel type | | C | Si | Mn | P | S | Al | N | Ni | Cu | Cr | Mo | Nb | Ti | V | Ca | Ca/S ratio | Carbon equivalent |
|---|---|---|---|---|---|---|---|---|---|---|---|---|---|---|---|---|---|---|
| Inventive steel | 1 | 0.04 | 0.2 | 1.41 | 0.008 | 0.001 | 0.02 | 0.003 | 0.27 | 0.2 | 0.3 | 0.15 | 0.04 | 0.012 | 0.04 | 0.0018 | 1.8 | 0.40 |
| | 2 | 0.035 | 0.25 | 1.43 | 0.006 | 0.0009 | 0.02 | 0.004 | 0.22 | 0.18 | 0.32 | 0.14 | 0.041 | 0.015 | 0.03 | 0.0016 | 1.8 | 0.40 |
| | 3 | 0.042 | 0.19 | 1.42 | 0.009 | 0.0008 | 0.025 | 0.004 | 0.25 | 0.17 | 0.29 | 0.17 | 0.039 | 0.011 | 0.04 | 0.0011 | 1.4 | 0.41 |
| Comparative steel | 1 | 0.11 | 0.25 | 1.44 | 0.008 | 0.0008 | 0.031 | 0.005 | 0.21 | 0.15 | 0.11 | 0.13 | 0.05 | 0.011 | 0.02 | 0.0015 | 1.9 | 0.43 |
| | 2 | 0.13 | 0.22 | 1.45 | 0.007 | 0.0007 | 0.021 | 0.005 | 0.18 | 0.18 | 0.35 | 0.25 | 0.033 | 0.013 | 0.035 | 0.0016 | 2.3 | 0.52 |
| | 3 | 0.032 | 0.24 | 2.11 | 0.008 | 0.0008 | 0.029 | 0.006 | 0 | 0 | 0.1 | 0.12 | 0.035 | 0.03 | 0.22 | 0.0011 | 1.4 | 0.47 |
| | 4 | 0.042 | 0.22 | 1.28 | 0.06 | 0.0011 | 0.038 | 0.007 | 0.05 | 0.08 | 0.22 | 0.15 | 0.044 | 0.013 | 0.23 | 0.0016 | 1.5 | 0.38 |
| | 5 | 0.039 | 0.25 | 1.44 | 0.008 | 0.0035 | 0.041 | 0.005 | 0.12 | 0.08 | 0.19 | 0.12 | 0.038 | 0.011 | 0.25 | 0.0018 | 0.5 | 0.40 |
| | 6 | 0.075 | 0.18 | 1.8 | 0.008 | 0.0009 | 0.025 | 0.005 | 0.41 | 0.25 | 0 | 0 | 0.045 | 0.012 | 0 | 0.0016 | 1.8 | 0.42 |
| | 7 | 0.068 | 0.25 | 1.4 | 0.006 | 0.001 | 0.035 | 0.005 | 0.18 | 0.13 | 0.31 | 0.13 | 0.002 | 0.011 | 0.022 | 0.0014 | 1.4 | 0.41 |
| | 8 | 0.042 | 0.19 | 1.42 | 0.008 | 0.0009 | 0.035 | 0.005 | 0.33 | 0.26 | 0.3 | 0.12 | 0.12 | 0.011 | 0.032 | 0.0015 | 1.7 | 0.41 |
| | 9 | 0.054 | 0.21 | 1.55 | 0.007 | 0.0011 | 0.03 | 0.004 | 0.12 | 0.08 | 0.28 | 0.12 | 0.042 | 0.002 | 0.025 | 0.0018 | 1.6 | 0.41 |
| | 10 | 0.044 | 0.22 | 1.38 | 0.008 | 0.0008 | 0.033 | 0.006 | 0.3 | 0.2 | 0.31 | 0.09 | 0.029 | 0.08 | 0.022 | 0.0014 | 1.8 | 0.39 |
| | 11 | 0.05 | 0.25 | 1.44 | 0.007 | 0.0008 | 0.035 | 0.005 | 0.2 | 0.15 | 0.3 | 0.12 | 0.032 | 0.012 | 0.035 | 0.0002 | 0.3 | 0.40 |
| | 12 | 0.047 | 0.24 | 1.48 | 0.009 | 0.001 | 0.028 | 0.004 | 0.22 | 0.08 | 0.28 | 0.15 | 0.035 | 0.011 | 0.027 | 0.0064 | 6.4 | 0.41 |
| | 13 | 0.075 | 0.21 | 1.88 | 0.007 | 0.0007 | 0.025 | 0.006 | 0.33 | 0.25 | 0.31 | 0.16 | 0.022 | 0.011 | 0.038 | 0.0015 | 2.1 | 0.53 |
| | 14 | 0.048 | 0.23 | 1.48 | 0.008 | 0.001 | 0.035 | 0.005 | 0.28 | 0.15 | 0.3 | 0.12 | 0.025 | 0.013 | 0.022 | 0.0014 | 1.4 | 0.41 |
| | 15 | 0.042 | 0.22 | 1.46 | 0.006 | 0.0011 | 0.023 | 0.006 | 0.22 | 0.12 | 0.36 | 0.12 | 0.032 | 0.015 | 0.022 | 0.0012 | 1.1 | 0.41 |
| | 16 | 0.043 | 0.21 | 1.48 | 0.009 | 0.0008 | 0.018 | 0.005 | 0.27 | 0.15 | 0.3 | 0.15 | 0.042 | 0.013 | 0.04 | 0.0018 | 2.3 | 0.42 |
| | 17 | 0.038 | 0.22 | 1.4 | 0.008 | 0.001 | 0.035 | 0.005 | 0.22 | 0.19 | 0.32 | 0.14 | 0.041 | 0.011 | 0.03 | 0.0015 | 1.5 | 0.40 |
| | 18 | 0.041 | 0.25 | 1.42 | 0.008 | 0.0007 | 0.035 | 0.004 | 0.25 | 0.2 | 0.29 | 0.17 | 0.036 | 0.012 | 0.04 | 0.0011 | 1.6 | 0.41 |
| | 19 | 0.044 | 0.24 | 1.55 | 0.007 | 0.0007 | 0.03 | 0.006 | 0.21 | 0.18 | 0.31 | 0.13 | 0.042 | 0.01 | 0.03 | 0.0015 | 2.1 | 0.42 |
| | 20 | 0.045 | 0.21 | 1.65 | 0.007 | 0.0008 | 0.023 | 0.005 | 0.18 | 0.17 | 0.3 | 0.13 | 0.029 | 0.011 | 0.05 | 0.0017 | 2.1 | 0.44 |
| | 21 | 0.051 | 0.23 | 1.4 | 0.007 | 0.001 | 0.025 | 0.004 | 0.33 | 0.15 | 0.28 | 0.12 | 0.035 | 0.015 | 0.03 | 0.0016 | 1.6 | 0.40 |
| | 22 | 0.049 | 0.28 | 1.53 | 0.006 | 0.0008 | 0.027 | 0.005 | 0.3 | 0.22 | 0.19 | 0.13 | 0.033 | 0.011 | 0.03 | 0.0015 | 1.9 | 0.41 |

TABLE 2

| Steel type | | Ar3 (° C.) | Heating temperature (° C.) | Finish rolling initiation temperature (° C.) | Finish rolling end temperature (° C.) | Cumulative rolling reduction rate upon finish rolling (%) | Direct quenching initiation temperature (° C.) | Direct quenching end temperature (° C.) | Direct quenching cooling rate (° C./sec) | Tempering temperature (° C.) | Thickness (mm) |
|---|---|---|---|---|---|---|---|---|---|---|---|
| Inventive steel | 1 | 773 | 1140 | 858 | 812 | 65 | 797 | 397 | 6 | 674 | 76 |
| | 2 | 778 | 1145 | 868 | 817 | 66 | 802 | 402 | 6 | 679 | 78 |
| | 3 | 769 | 1128 | 834 | 805 | 62 | 788 | 388 | 8 | 665 | 66 |
| Comparative steel | 1 | 756 | 1135 | 819 | 792 | 63 | 776 | 376 | 7 | 653 | 70 |
| | 2 | 737 | 1152 | 822 | 775 | 63 | 759 | 359 | 7 | 636 | 70 |
| | 3 | 741 | 1144 | 806 | 778 | 63 | 761 | 361 | 8 | 638 | 68 |
| | 4 | 793 | 1133 | 856 | 829 | 60 | 811 | 361 | 10 | 688 | 60 |
| | 5 | 782 | 1121 | 867 | 821 | 62 | 804 | 404 | 8 | 681 | 65 |
| | 6 | 735 | 1137 | 825 | 774 | 62 | 757 | 357 | 8 | 634 | 65 |
| | 7 | 772 | 1138 | 835 | 808 | 64 | 793 | 393 | 7 | 670 | 73 |
| | 8 | 770 | 1122 | 855 | 809 | 66 | 794 | 394 | 6 | 671 | 77 |
| | 9 | 767 | 1135 | 857 | 806 | 62 | 789 | 389 | 8 | 666 | 65 |
| | 10 | 775 | 1138 | 840 | 811 | 63 | 795 | 395 | 8 | 672 | 68 |
| | 11 | 774 | 1145 | 837 | 810 | 64 | 794 | 394 | 7 | 671 | 72 |
| | 12 | 770 | 1125 | 855 | 808 | 64 | 793 | 393 | 7 | 670 | 73 |
| | 13 | 716 | 1144 | 806 | 755 | 62 | 738 | 338 | 8 | 615 | 66 |
| | 14 | 769 | 1088 | 834 | 805 | 66 | 791 | 391 | 6 | 668 | 78 |
| | 15 | 774 | 1315 | 837 | 810 | 65 | 795 | 396 | 6 | 672 | 75 |
| | 16 | 764 | 1125 | 954 | 813 | 62 | 796 | 396 | 8 | 673 | 65 |
| | 17 | 773 | 1122 | 858 | 788 | 61 | 830 | 430 | 9 | 664 | 62 |
| | 18 | 768 | 1125 | 858 | 807 | 35 | 789 | 389 | 9 | 666 | 64 |
| | 19 | 761 | 1144 | 851 | 796 | 61 | 749 | 349 | 9 | 626 | 63 |
| | 20 | 756 | 1133 | 846 | 795 | 62 | 778 | 588 | 8 | 655 | 65 |
| | 21 | 766 | 1123 | 851 | 805 | 61 | 787 | 387 | 4 | 664 | 62 |
| | 22 | 759 | 1129 | 849 | 798 | 62 | 781 | 381 | 8 | 745 | 67 |

(wherein Ar3 = 910 − 31 O*C − 80*Mn − 20*Cu − 15*Cr − 55*Ni − 80*Mo + 0.35*(thickness − 8)

TABLE 3

| Steel type | | Microstructure | A length (micron) of the longest side of Ti- and Nb-based carbonitride in the thickness center | Tensile strength before tempering (MPa) | Tensile strength after tempering (MPa) | Tensile strength variation before and after tempering (MPa) | DWTT shear fracture rate | Hydrogen-induced cracking |
|---|---|---|---|---|---|---|---|---|
| Inventive steel | 1 | TB | 5.3 | 523 | 536 | 13 | 96 | No occurring |
| | 2 | TB | 4.8 | 531 | 540 | 9 | 100 | No occurring |
| | 3 | TB | 4.2 | 517 | 533 | 16 | 99 | No occurring |

TABLE 3-continued

| Steel type | Microstructure | A length (micron) of the longest side of Ti- and Nb-based carbonitride in the thickness center | Tensile strength before tempering (MPa) | Tensile strength after tempering (MPa) | Tensile strength variation before and after tempering (MPa) | DWTT shear fracture rate | Hydrogen-induced cracking |
|---|---|---|---|---|---|---|---|
| Comparative steel | 1 TB | 6.3 | 520 | 474 | −46 | 94 | Occurring |
| | 2 TM | 6.6 | 584 | 521 | −63 | 77 | Occurring |
| | 3 TM | 4.8 | 570 | 579 | 9 | 53 | Occurring |
| | 4 TB | 4.3 | 521 | 533 | 12 | 37 | No occurring |
| | 5 TB | 4.2 | 511 | 519 | 8 | 45 | Occurring |
| | 6 TB + F | 3.1 | 475 | 488 | 13 | 99 | No occurring |
| | 7 TB | 3.8 | 515 | 480 | −35 | 98 | No occurring |
| | 8 TB + F | 12.6 | 476 | 495 | 19 | 73 | Occurring |
| | 9 TB | 3.2 | 505 | 513 | 8 | 73 | No occurring |
| | 10 TB | 6.7 | 516 | 515 | −1 | 45 | Occurring |
| | 11 TB | 4.8 | 518 | 533 | 15 | 87 | Occurring |
| | 12 TB | 4.9 | 511 | 526 | 15 | 85 | Occurring |
| | 13 TM | 4.9 | 575 | 579 | 4 | 46 | Occurring |
| | 14 TB + F | 24.3 | 466 | 445 | −21 | 31 | Occurring |
| | 15 TB | 4.8 | 514 | 522 | 8 | 65 | No occurring |
| | 16 TB | 13.1 | 523 | 533 | 10 | 63 | No occurring |
| | 17 TM + F | 3.3 | 455 | 470 | 15 | 88 | No occurring |
| | 18 TB | 4.6 | 512 | 523 | 11 | 64 | No occurring |
| | 19 TM + F | 4.4 | 473 | 491 | 18 | 89 | No occurring |
| | 20 TB + F | 5.3 | 444 | 463 | 19 | 86 | No occurring |
| | 21 TB + F | 5.5 | 425 | 459 | 34 | 94 | No occurring |
| | 22 TB | 12.2 | 523 | 485 | −38 | 72 | No occurring |

(wherein TB: tempered bainite, F: ferrite, TM: tempered martensite)

As shown in the above Tables 1 to 3, inventive steels 1 to 3 are according to the steel components, manufacturing conditions and microstructure of the present disclosure, and it is recognized that inventive steels 1 to 3 maintained a carbon equivalent at 0.45 or less, have tensile strength of 500 MPa or more, tensile strength after tempering heat treatment of 500 MPa or more, a DWTT shear fracture percentage (−20° C.) of 80% or more, and a hydrogen-induced cracking sensitivity (CLR) of 0% (No hydrogen-induced cracking), and thus, having excellent low-temperature DWTT properties and hydrogen-induced cracking resistance.

However, Comparative steels 1 to 22 in which any one or more of the component ranges and manufacturing conditions are out of the ranges of those of the present disclosure had tensile strength of 500 MPa or less, a hydrogen-induced cracking sensitivity (CLR) being poor, or a DWTT shear fracture percentage (−20° C.) less than 80%.

Meanwhile, FIGS. 1 and 2 illustrate tensile strength variations after tempering heat treatment depending on the contents of C and Nb, for Inventive steels 1-3, and Comparative steels 1-13, and it is recognized that when the content of C is more than 0.08 wt % as in FIG. 1, tensile strength is rapidly decreased after tempering heat treatment, and even when the content of C is 0.08 wt % or less, the steel to which Nb was not added as in FIG. 2 had decreased strength.

Through Tables 1 to 3, and FIGS. 1 to 2, it is recognized that by manufacturing the steel plates according to the Examples of the present disclosure, the thick steel plate having excellent low-temperature DWTT properties and hydrogen-induced cracking resistance of a carbon equivalent of 0.45 or less, a thickness of 80 mm or less, a tensile strength grade of 500 MPa or higher may be obtained.

The invention claimed is:

1. A thick steel plate having excellent low-temperature toughness and hydrogen-induced cracking resistance, comprising: 0.02-0.08 wt % of C, 0.1-0.5 wt % of Si, 0.8-2.0 wt % of Mn, 0.03 wt % or less of P, 0.003 wt % or less of S, 0.06 wt % or less of Al, 0.01 wt % or less of N, 0.005-0.1 wt % of Nb, 0.005-0.05 wt % of Ti and 0.0005-0.005 wt % of Ca, one or two of 0.005-0.3% of Cu and 0.005-0.5% of Ni, and one or more of 0.05-0.5 wt % of Cr, 0.02-0.4 wt % of Mo and 0.005-0.1 wt % of V, with a balance of Fe and other unavoidable impurities, the thick steel plate having a carbon equivalent (Ceq) value as defined by the following Equation 1 satisfying 0.45 or less:

$$\text{Carbon equivalent (Ceq)}=C+Mn/6+(Cr+Mo+V)/5+(Cu+Ni)/15 \quad \text{[Equation 1]}$$

wherein C, Mn, Cr, Mo, V, Cu, and Ni represent a content of each element by wt %, and a weight ratio of Ca/S satisfying a range between 0.5 and 5.0, and including tempered bainite (including tempered acicular ferrite) or tempered martensite as a matrix structure, wherein a length of a longest side of a Ti-based, Nb-based, or Ti-Nb composite carbonitride within 5 mm upwards and downwards with respect to a thickness center is 10 μm or less.

2. The thick steel plate of claim 1, wherein the carbon equivalent (Ceq) is 0.37-0.45.

3. The thick steel plate of claim 1, wherein the P is comprised in an amount of 0.01 wt % or less, and the S is comprised in an amount of 0.002 wt % or less.

4. The thick steel plate of claim 1, wherein the thick steel plate has tensile strength of 500 MPa or more.

5. The thick steel plate of claim 1, wherein the thick steel plate has a decrease in tensile strength after tempering of 30 MPa or less.

6. The thick steel plate of claim 1, wherein the thick steel plate has a thickness of 40-80 mm.

7. A method for manufacturing a thick steel plate having excellent low-temperature toughness and hydrogen-induced resistance, the method comprising: reheating a steel slab at 1,100-1,300° C., the steel slab including 0.02-0.08 wt % of C, 0.1-0.5 wt % of Si, 0.8-2.0 wt % of Mn, 0.03 wt % or less of P, 0.003 wt % or less of S, 0.06 wt % or less of Al, 0.01 wt % or less of N, 0.005-0.1 wt % of Nb, 0.005-0.05 wt % of Ti and 0.0005-0.005 wt % of Ca, one or two of 0.005-0.3% of Cu and 0.005-0.5% of Ni, and one or more of 0.05-0.5 wt % of Cr, 0.02-0.4 wt % of Mo and 0.005-0.1 wt % of V, with a balance of Fe and other unavoidable impurities, and having a carbon equivalent (Ceq) value as defined by the following Equation 1 satisfying 0.45 or less:

$$\text{Carbon equivalent (Ceq)}=C+Mn/6+(Cr+Mo+V)/5+(Cu+Ni)/15 \quad \text{[Equation 1]}$$

wherein C, Mn, Cr, Mo, V, Cu, and Ni represent a content of each element by wt %, and a Ca/S weight ratio satisfying a range of 0.5-5.0, then finish rolling the steel slab with a cumulative rolling reduction ratio of 40% or more at a temperature of Ar3+100° C.-Ar3+30° C., starting direct quenching with a cooling rate of 8° C./s or less as defined by the following Equation 2 at a temperature of Ar3+80° C.-Ar3 and finishing cooling at 500° C. or less:

$$20{,}000/\text{Thickness}^2\ (\text{mm}^2) \leq \text{cooling rate}(^\circ\ \text{C./sec}) \leq 60{,}000/\text{thickness}^2\ (\text{mm}^2), \quad \text{[Equation 2]}$$

and performing reheating at a temperature of 580-700° C. and air cooling.

8. The method of claim 7, wherein the carbon equivalent (Ceq) is 0.37-0.45.

9. The method of claim 7, wherein P is comprised in an amount of 0.01 wt % or less, and the S is comprised in an amount of 0.002 wt % or less.

10. The thick steel plate of claim 7, wherein the thick steel plate has a thickness of 40-80 mm.

* * * * *